United States Patent [19]

Metcalf

[11] Patent Number: 4,926,788

[45] Date of Patent: May 22, 1990

[54] CAN COATER/DECORATOR MANDREL SYSTEM

[75] Inventor: Robert L. Metcalf, Beaverton, Oreg.

[73] Assignee: Wilbanks International, Inc., Hillsboro, Oreg.

[21] Appl. No.: 202

[22] Filed: Jan. 2, 1987

[51] Int. Cl.[5] ..... B05C 13/02

[52] U.S. Cl. ..... 118/500; 118/46

[58] Field of Search ..... 118/46, 550; 101/38 R, 101/38 A, 39, 40; 29/116 R, 129.5

[56] References Cited

U.S. PATENT DOCUMENTS

| | | | |
|---|---|---|---|
| 3,889,630 | 6/1975 | Szpitalak | 118/46 |
| 3,960,073 | 6/1976 | Rush | 101/40 |
| 4,267,771 | 5/1981 | Stirbis | 101/40 |
| 4,380,964 | 4/1983 | Abe et al. | 118/500 X |

*Primary Examiner*—John McIntosh

*Attorney, Agent, or Firm*—Klaas & Law

[57] ABSTRACT

A mandrel system for a can coating or decorating machine or the like comprising a ceramic sleeve member for supporting a workpiece and a sleeve support core member for supporting the ceramic sleeve member and at least two axially spaced bearing units supported by the sleeve support core member and/or the support core member.

6 Claims, 2 Drawing Sheets

Fig. 4.
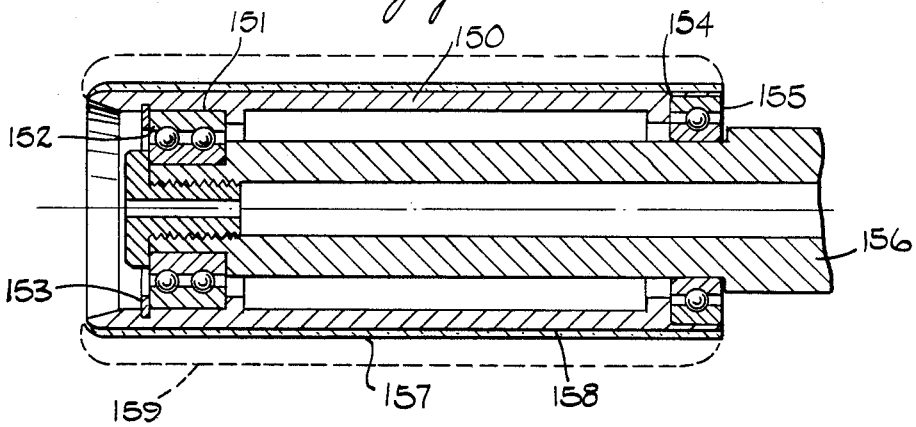
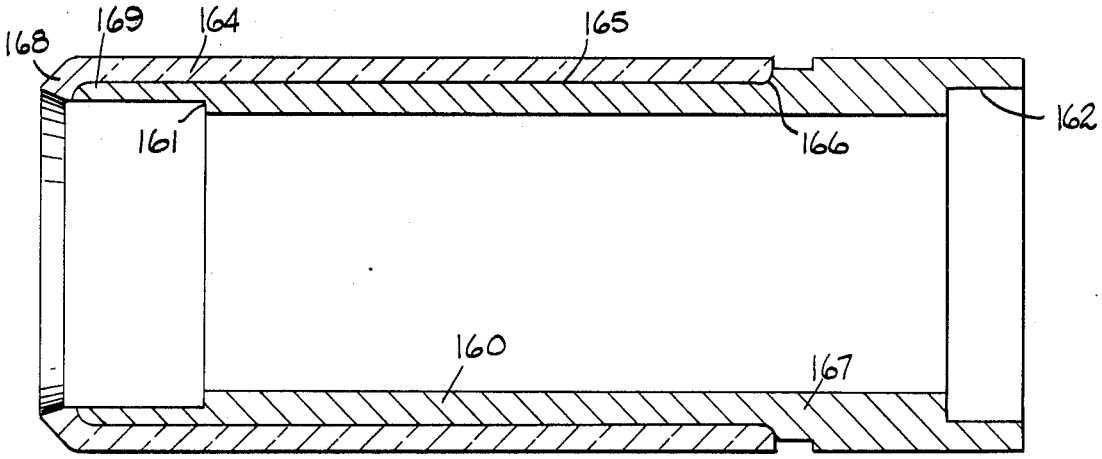
Fig. 5.

CAN COATER/DECORATOR MANDREL SYSTEM

BACKGROUND OF THE INVENTION

The present invention relates to mandrel systems for supporting a workpiece during manufacturing operations, and more particularly, to rotatable mandrel systems for holding a container such as a one-piece can body member during a coating or decorating operation on a conventional coating or decorating machine.

In high speed continuous coating or decoration of one-piece aluminum or steel can body members, the can body members are supported on a plurality of circumferentially spaced mandrel assemblies carried by a continuously rotating mandrel wheel for engagement of the outer peripheral can surface with ink transfer blanket segments on a rotating blanket wheel of a decorator machine or for engagement with a coating applicator roll of a coating machine. The mandrel wheel and mandrel assemblies of such coater and decorator machines are of generally similar construction. Decorators of this general type are described and shown in the following United States patents, the disclosures of which are incorporated herein by reference: Sirvet 4,037,530; McMillin et al. 4,138,941; Dugan, et al. 4,222,479; Stirbis 4,267,771; Hahn 4,441,418; Stirbis 4,445,431; Stirbis 4,491,068; Stirbis 4,498,387; and Stirbis 4,509,555. Such decorator apparatus is continuously operated by a motor means and a drive means with the various wheel means rotating synchronously. The construction and arrangement is such that each can member is decorated along approximately 20 degrees of each 360 degree revolution of the mandrel wheel means when in contact with a blanket segment. Decorator apparatus of this type are operable between relatively low speeds of approximately 500 cans per minute and relatively high speeds of 1200 to 1400 or more cans per minute.

In general, each of the mandrel assemblies comprise a central support spindle shaft means attached to and carried in a circumferential path by the rotatable mandrel wheel. A mandrel means is rotatably mounted on each of the spindle shaft means by suitable bearing means. Mandrel assemblies of this type are shown and described in the following United States patents, the disclosures of which are incorporated herein by reference: Stirbis 4,267,771; Sirvet 4,037,530; Demierre 3,710,712; Cohan 3,388,686 and Zurick 3,356,019.

In the past, the mandrel means has been made of precision machined metallic steel alloy material or in some cases, plastic materials, such as Nylatron, have been utilized. There are several problems associated with prior art mandrel systems. A major problem is that the prior art mandrel systems are subject to a high degree of wear and must be periodically replaced at substantial cost. There may be substantial loss of production when the mandrels become unsatisfactory due to inadvertent production of defective cans and lack of production during machine down-time when unsatisfactory mandrels must be replaced. Another problem is that the mandrels must be dimensionally accurate with relatively close tolerances to properly fit inside the cans and also have accurate alignment on the mandrel wheel. Many prior art mandrel designs require more high performance costly bearing units and relatively costly support structure. In addition, weight of the mandrel is a limiting factor in high speed operations so that relatively light-weight mandrels are preferable to relatively heavy-weight mandrels.

While a Nylatron mandrel is light weight and enables easy loading and unloading of the can member thereon, the life expectancy is about five weeks when used 24 hours per day for 7 days per week at 1000 can per minute printing speeds. A diameter of 2.576 inches will deteriorate to 2.568 inches in a five week period due to wear. The mandrels must then be replaced as this diameter variance will no longer allow proper printing. Diameter variance is also caused by expansion and shrinkage due to variations in the plant temperature. The plant ambient temperature may fluctuate as much as 50 degrees F. in a day. In addition, abrasion resistance is also proportional to temperature. The thermal coefficient of expansion of Nylatron is $20\times10$ to minus sixth power. A Nylatron plastic material will cold flow under pressure and must, therefore, be supported by other means to make it suitable for a mandrel. Additional bearings are added to give center span support. A four bearing system is currently used on one commercially available printer. The more bearings that are used, the more alignment problems that are encountered with increased cost of not only the mandrel, but also the spindle. Of course, additional parts add additional mass. During printing, the mandrel position must be altered and mandrel mass therefor may be a limiting factor for high printing speeds. The use of Nylatron has been attractive because a Nylatron mandrel by itself typically weighs approximately 1.5 pounds and with its additional required support hardware approximately 2.1 pounds.

Steel alloy materials are used to obtain longevity and dimensional stability. Only two bearings are required. However, a steel mandrel will weigh approximately 4.75 pounds. Steel mandrels are also subject to coating with oxidized aluminum from the aluminum cans which adheres to the steel mandrel surface and, in turn, damages the can. Cans used for soft drink beverages containing phosphoric acid, such as cola beverages, are particularly vulnerable to residue such as oxidized aluminum which may be transferred to the inside of the can and adversely affect beverage taste. High speed coater/decorator machines operate at about 1200 cans per minute, sustained production, speeds and may operate at as high as 1600 cans per minute. It is now contemplated that production speeds of 1600 to 2200 cans per minute may be attained so that mandrel weight becomes a more critical factor. However, when such speeds are reached, the wear life of the mandrels will decrease and a plastic mandrel will have a useful life of about 3 to 3.5 weeks or less and down time from defects caused by dimensional changes, etc. will be an increasing production problem.

SUMMARY OF INVENTION

The present mandrel structure is specifically intended for use with two-piece, drawn-and-ironed cans, but may be applicable to any tubular or open-ended cylindrical object. Thus, the term "cans", as used herein, is intended to include containers and other cylindrical objects in general.

A primary objective of the present invention is to provide a mandrel system employing a workpiece supporting mandrel which is light weight, dimensionally stable, abrasion and wear resistant, and will not adversely affect food and beverages in the mandrel containers.

Another object is to provide improved mandrel bearing support means enabling better bearing life and accuracy during high speed rotation in high-speed can printing.

Another object is to provide hard bearing bushings which may replace the conventional ball or roller bearings used in existing mandrel structures.

A further object is to enable replacement of existing mandrels with new mandrels made in accordance with the present invention.

In general, the present invention comprises a mandrel assembly having a cylindrical can supporting member made of one piece of ceramic material or having a ceramic coating and a mounting member made of metal or other material to which the ceramic member or coating is fixedly attached. The mandrel assembly is constructed and arranged to engage and be supported by bearing means mounted on a mandrel spindle shaft and engaging the mounting member or also the ceramic can support member. The construction and arrangement may be such as to enable replacement of existing prior art mandrel assemblies on existing coating and decorating machines. The ceramic member may be attached to the support member by a shrink fit, a press fit or by adhesive bonding. A ceramic coating may be applied by a vapor deposition process. The bearing means may be conventional single or double ball-type bearing units and/or conventional roller or needle-type bearing units. Only a front bearing means and a rear bearing means are required. The front and rear bearing means may be mounted in the non-ceramic support member or the front bearing means may be mounted in the ceramic member and the rear bearing means may be mounted in the non-ceramic support member. The rear bearing means may be mounted on the mandrel by shrink fit, press fit or adhesive bonding while the front bearing may be mounted by a close tolerance slip fit into an integral annular bushing surface in the ceramic material with use of a snap ring retainer device.

BRIEF DESCRIPTION OF THE DRAWINGS

Illustrative and presently preferred embodiments of the invention are shown in the accompanying drawings in which:

FIG. 4 is a cross-sectional view of a fourth embodiment; and

FIG. 5 is a cross-sectional view of a fifth embodiment.

DETAILED DESCRIPTION

Figure 1:
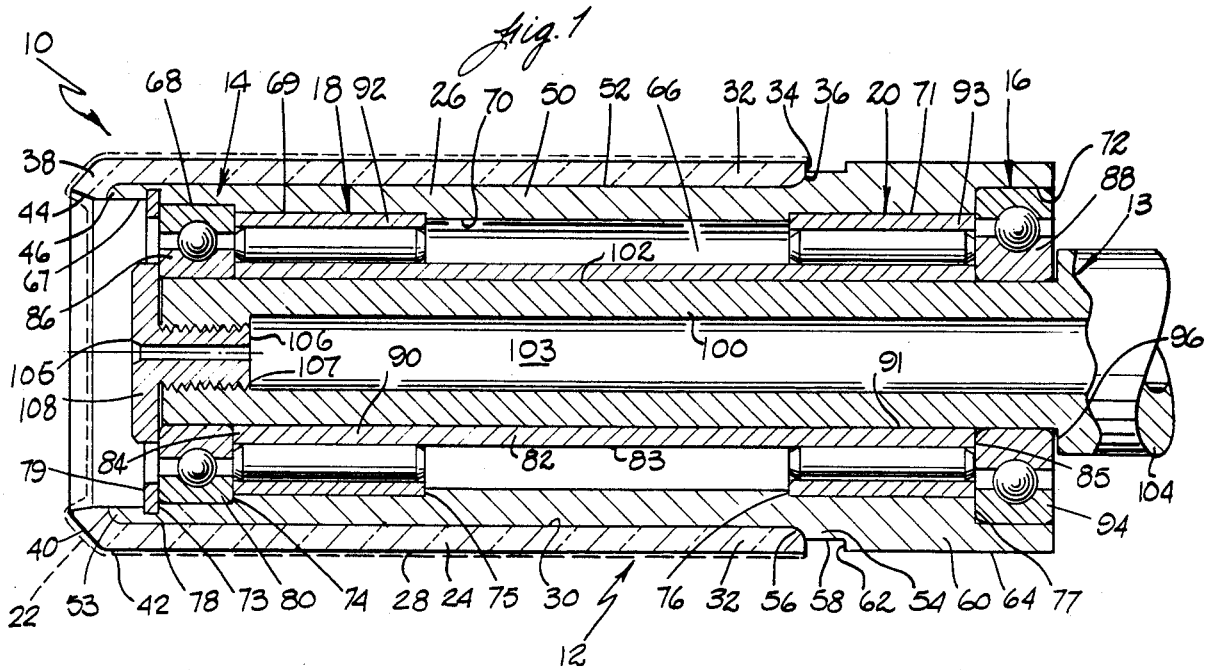
FIG. 1 is a cross-sectional view of one embodiment of a mandrel assembly in association with a mandrel spindle of a conventional decorator machine.

FIG. 1 shows a mandrel assembly 10 comprising a rotatable mandrel means 12 mounted on a conventional mandrel support shaft means 13 by conventional axially spaced ball bearing unit means 14, 16 and needle bearing means 18, 20 for rotatably supporting a workpiece such as a cylindrical one-piece can body member thereon as illustrated by dotted lines at 22. Mandrel means 12 comprises a workpiece support sleeve means in the form of an outer elongated sleeve member 24 made of one piece of ceramic material and a ceramic sleeve support core means in the form of support core member 26 made of one piece of suitable rigid material such as steel, aluminum or plastic. Outer sleeve member 24 comprises an elongated cylindrical outer peripheral surface 28 and an elongated cylindrical inner peripheral surface 30. A rear end portion 32 has a flat, transverse, annular shoulder surface 34 and a rounded, annular inner surface 36. The front end portion has an annular, inwardly inclined lip portion 38 defined by an inwardly inclined annular end surface 40 connected to outer surface 28 by an annular rounded surface 42, an axially inwardly inclined annular inner surface 44 connected to inner cylindrical surface 30 by a curved annular shoulder surface 46.

Mandrel core member 26 comprises an elongated sleeve support portion 50 having an outer cylindrical peripheral surface 52 terminating in a rounded annular lip surface 53. An intermediate cylindrical portion 54 of enlarged diameter provides a rounded annular shoulder surface 56 connected to annular cylindrical outer peripheral surface 58. A rear end portion 60 of further enlarged diameter provides a flat annular shoulder surface 62 connected to an annular cylindrical outer peripheral surface 64. Core member 26 has a central elongated bore 66 of varying diameter extending therethrough to provide bearing journal seat means for bearing units 14, 16, 18, 20 including annular inner peripheral cylindrical surfaces 67, 68, 69, 70, 71, 72 and annular flat abutment shoulder surfaces 73, 74, 75, 76, 77. an annular snap ring groove 78 is provided adjacent shoulder surface 73 to receive a conventional snap ring member 79 which abuts outer race member 80 of ball bearing unit 14. An elongated, conventional bearing support and spacer sleeve member 82 having a cylindrical outer peripheral surface 83 extends between and has end surfaces 84, 85 abutting inner race members 86, 88 of ball bearing units 14, 16. Bearing sleeve member 82 also provides inner support race portions 90, 91 for needle bearing units 18, 20. Outer race members 92, 93 of needle bearing units 18, 20 abut shoulders 75, 76 and outer race members 80, 94 of ball bearing units 14, 16. Outer race member 94 of ball bearing unit 16 abuts shoulder 77 and inner race member 88 is held in place during use by a shoulder surface 96 on the mandrel shaft 13. Bearing unit 16 may be press-fit into journal 72 during factory assembly of mandrel assembly means 10.

Mandrel support shaft means 13 comprises a rigid metallic tubular member 100 having an accurately machined cylindrical outer peripheral surface 102 and a central passage 103 for connection to a supply of compressed air and/or a vacuum source (not shown) for aiding in mounting and discharge of the can body member relative to the mandrel assembly in a conventional manner. The rear end portion 104 of the support shaft means is supported on a conventional mandrel wheel means structure of a coater or decorator machine in a conventional manner. A conventional flanged retainer bolt means 105 has a hollow threaded shaft portion 106 mounted in a threaded end portion 107 of passage 103 and an annular flanged end portion 108 for engaging the inner race member 86 of bearing means 14.

In construction and assembly of the mandrel means 12, the ceramic support sleeve member 24 is separately made from a conventional ceramic material in a conventional manner to highly accurate dimensional tolerances. The outer peripheral surfaces 28, 40, 42 are ground and polished. The support core member 26 is separately made from a highly accurately machined piece of metal or a highly accurately formed plastic material. The ceramic sleeve member 24 is permanently mounted on core member 26 as shown in FIG. 1 by use of a suitable bonding compound, such as an epoxy adhesive material, between cylindrical surfaces 30 and 52. The thickness of the cylindrical wall portion of the ceramic sleeve member is on the order of 0.190 to 0.200 inch.

In use as a replacement for a conventional mandrel means, the conventional mandrel means and bearing means are removed from the mandrel support shaft means 13. Then, the ceramic mandrel means and bearing means are mounted on the mandrel support shaft means.

Figure 2:
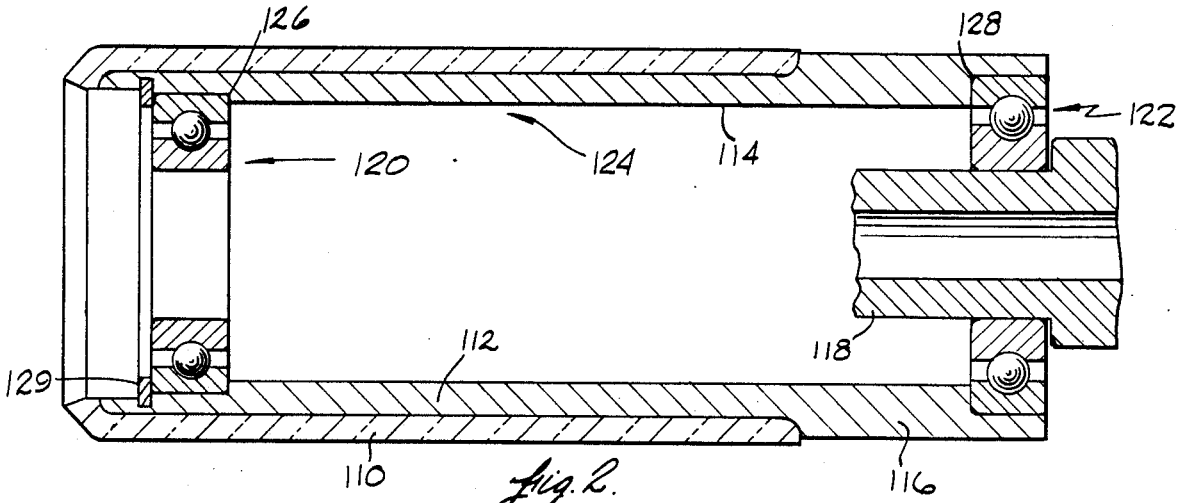
FIG. 2 is a cross-sectional view of a second embodiment of a mandrel assembly.

FIG. 2 shows an alternative construction for an assembly for a coater machine of conventional design. A mandrel workpiece support sleeve means in the form of a ceramic sleeve member 110 is mounted on a support core member 112 as previously described. Core member 112 has a central passage 114 and a cylindrical rear end portion 116 mounted on a conventional mandrel shaft 118 as previously described. In this construction only, two ball bearing units 120, 122 are required so that the inside configuration of support core means 124 is modified to provide only two axially spaced bearing seat portions 126, 128. Front bearing unit 126 is mounted by a slip fit and held by a snap ring 129. Rear bearing unit 128 is mounted by a press fit or a bonding agent.

Figure 3:
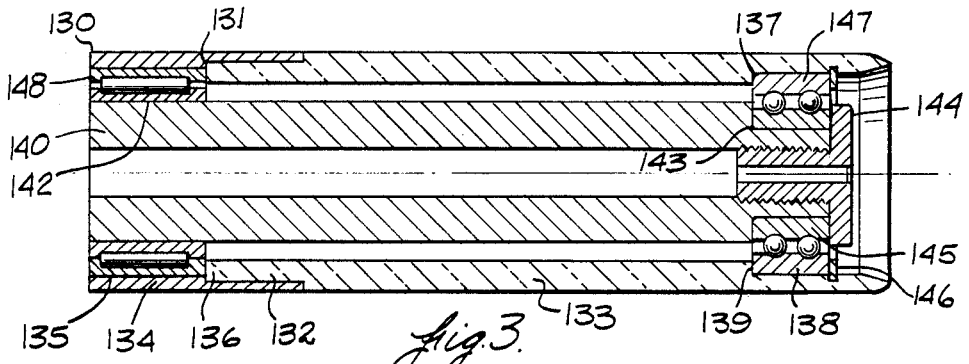
FIG. 3 is a cross-sectional view of a third embodiment of a mandrel assembly.

FIG. 3 shows another alternative construction for another type of conventional decorator. In this embodiment, a sleeve support core means in the form of a metallic support member 130 having a counterbore 131 is mounted on a reduced diameter rear end portion 132 of a workpiece support sleeve means in the form of a ceramic sleeve member 133, made from a ceramic zirconia material, by heat shrinking. A first needle bearing journal seat means 134 is provided in the rear end portion of support member 130 by inner peripheral cylindrical surface 135 and end surface 136 of the ceramic member. A second, double ball bearing unit journal seat means 137 is provided in the front end portion of the ceramic sleeve member by a counterbore 138 and a shoulder 139. A conventional mandrel shaft 140 has bearing journal portions 142, 143 and an end cap 144 which engages inner race member 145. A snap ring 146 is mounted in ceramic sleeve member 133 to engage outer race 147 which is slip fit in journal means 137. Outer needle bearing race 148 may be press fit into journal means 134.

FIG. 4 shows another alternative construction wherein a support core member 150 is made from aluminum material and has a counterbore 151 in a front end portion to provide a front bearing seat means for a double ball bearing unit assembly 152 held by a snap ring member 153 and a counter-bore 154 in a rear end portion to provide a rear bearing seat means for a rear press-fitted single-unit ball bearing assembly 155 supported on a conventional mandrel shaft 156. In this embodiment, the workpiece support sleeve means comprises a layer of ceramic material 157 which is vacuum-deposited on the outer peripheral surfaces 158 of the support core member 150 by a ceramic coating vapor-deposition process indicated by dotted lines 159. The vapor deposit technique causes mechanical or chemical/mechanical bond attachment to the metal. In this manner, core member 150 is provided with a relatively thin wall, e.g., 0.001 to 0.005 inch, relatively lightweight, non-porous vapor-deposited coating of a high abrasion resistant ceramic material such as titanium carbide, boron carbide, tungsten carbide, zirconium carbide or silicon nitride ceramic material.

In the embodiment of FIG. 5, the support core member 160 has counterbore bearing seat means 161, 162. The ceramic workpiece support sleeve member 164 is mounted on a cylindrical peripheral mounting surface 165 and an annular shoulder 166 of a reduced diameter portion 167 of the core member 160 with a tip portion 168 on a rounded end portion 169 of the core member.

The ceramic may be of aluminum oxide, zirconium oxide, silicon carbide, tungsten carbide, silicon nitride, tungsten nitride, but is not limited to these ceramic materials. Aluminum oxide is preferred as it may be polished to a two micro inch surface finish providing a surface which does not damage the interior of the can and allows the can to be easily loaded and unloaded at high rates of speed. Aluminum oxide has a thermal expansion coefficient of $3.3\times10$ to the minus sixth power inches per inch per degree F. whereas, Nylatron plastic material has a thermal expansion coefficient of $20\times10$ to the minus sixth power or more than six times that of aluminum oxide ceramic. This low expansion coefficient provides a dimensional stable reference mounting for the can over the temperature ranges found in manufacturing plants, (60N to 120 Degrees F.). Aluminum oxide is one of the hardest of all man made materials, listed next to diamond on the Mohs scale. This hardness provides abrasion resistance and therefore an unchanging dimension for years of life. Aluminum oxide is naturally white in color and therefore provides a background which allows sensors to identify whether a can is properly located for accurate printing. Aluminum oxide is stiff having flexural modulus of $45\times10^6$ psi therefore providing a distortion free printing reference under high speed printing loads. Aluminum oxide is light weight. The complete assembly weighs as little as 1.6 pounds. A mandrel, as reduced to practice, using a steel core per drawing FIG. 2, weighs 2.25 pounds.

The present invention provides extremely low and substantially eliminates surface wear. Ceramic supported bearings may be mounted by a slip fit so as to eliminate transfer of pressure forces to the ceramic and eliminate galling and bearing seizure problems during operation. The ceramic support core members may be made of malleable material to enable press fit retention of the bearing units mounted therein. The outer peripheral surfaces of the ceramic material may be manufactured to extremely close tolerances to enable very accurate can fit thereon while also enabling easy loading and unloading of the cans. Bearing units can be pre-assembled in order to supply a complete mandrel assembly for association with standard mandrel shafts on existing machines and the bearing units may be easily replaced as necessary or desirable.

Thus, the present invention provides mandrel apparatus for supporting a workpiece in parallel coaxial relationship to the central axis of a mandrel support shaft comprising: a cylindrical workpiece support sleeve means made of one piece of ceramic material or having a ceramic coating thereon and having a central cylindrical bore extending therein with a central longitudinal axis and a cylindrical outer peripheral surface which is concentric to said central longitudinal axis for supporting the workpiece relative to the support shaft. A sleeve support core means is made of metallic material and may be of variable construction and design to accommodate mandrel shafts of varying construction and design; however, the use of aluminum material is preferred for weight reduction. At least two axially spaced bearing support means are provided by the workpiece support sleeve means and/or the sleeve support core means. One of the bearing support means may be provided by the ceramic workpiece support sleeve means. At least one bearing support means is made of metallic material and has a central cylindrical bore extending therein with a central longitudinal axis and at least one precision cylindrical bearing support surface associated with the cylindrical bore for receiving and supporting at least one bearing unit means coaxially associated with the support shaft. An interface means provides a cylindrical surface interface between adjoining portions of the cylindrical workpiece support sleeve means and the sleeve support core means. Fastening means are associated with the interface means for fixedly connecting the workpiece support sleeve means to the sleeve support core means.

In one embodiment of the invention, the sleeve support core means comprises an elongated sleeve member made of aluminum material and having a pair of axially spaced cylindrical bearing surfaces with associated radially inwardly extending bearing shoulders for receiving and supporting a pair of axially spaced bearing unit means mounted on the support shaft. The interface means comprises an elongated cylindrical outer surface on the sleeve support core means and an elongated cylindrical inner surface on the workpiece support sleeve means.

In another embodiment of the invention, the sleeve support core means further comprises an end member attached to a rear end portion of the workpiece support sleeve means and is made of steel material having an outer peripheral cylindrical surface which is substantially concentric with the outer peripheral cylindrical surface of the workpiece support sleeve means. The interface means comprises a counterbore in the sleeve support core means and a reduced diameter end portion of the workpiece support sleeve means fixedly located in the counterbore. The fastening means comprises a heat shrink fit between the counterbore portion of the support core means and the reduced diameter end portion of the support sleeve means. The support sleeve means comprises in internal cylindrical bearing support means provided by a cylindrical ceramic surface and radially inwardly extending ceramic shoulder surface at the front-loading end thereof opposite the rear end portion for receiving and supporting a bearing means unit associated with the support shaft.

In all embodiments, the workpiece support sleeve means comprises a loading end tip portion having a beveled outer surface for receiving and guiding and locating the workpiece onto the support sleeve means. A beveled inner surface at the front end tip portion facilitates insertion of the bearing unit means and provides space for a domed bottom wall portion of the can body member mounted on the support sleeve means. Groove means are provided adjacent the beveled inner surface for receiving snap ring means for holding the bearing unit means in the counterbore.

While various illustrative and preferred embodiments of the invention has been shown and described herein, it is contemplated that the inventive concepts may be otherwise variously employed in other alternative and modified embodiments of the invention. For example, the internal bearing journal configurations of the workpiece support sleeve means and the sleeve support core means may be variously modified and arranged to accommodate various sizes and kinds of bearing units and bearing unit support structure. In addition, the size and shape of the ceramic workpiece support sleeve means may be varied to accommodate workpieces of varying sizes and shapes. Thus, it is intended that the scope of the appended claims be construed to include other alternative and modified embodiments of the invention except insofar as limited by the prior art.

What is claimed is:

1. Apparatus for supporting a cylindrical can body workpiece having a cylindrical side wall portion and a bottom wall portion in parallel coaxial relationship to the central axis of a mandrel support shaft of a can decorating machine or the like comprising:

a cylindrical workpiece support sleeve means made of a separately formed one piece solid monolithic body of ceramic material and having an axially central cylindrical bore extending therein with a central longitudinal axis and an elongated cylindrical outer peripheral surface which is concentric to said central longitudinal axis for supporting the cylindrical side wall portion of the workpiece in circumjacent relationship to the support shaft and having an axially innermost end portion and an axially outermost tip portion with a radially inwardly extending interior surface and a radially inwardly extending exterior surface having a profile corresponding to the profile of the bottom wall portion of the workpiece for engaging and supporting the bottom wall portion of the workpiece and having an elongated cylindrical inner peripheral surface which is concentric to said central longitudinal axis;

a support core means made of one piece of metallic material for fixedly supporting said workpiece support sleeve means and having a central cylindrical bore extending therein with a central longitudinal axis which is coaxial with said workpiece support sleeve means for rotatably supporting said workpiece support sleeve means and said support core means in coaxial circumjacent relationship to the support shaft;

said support core means having an elongated cylindrical outer peripheral surface which is concentric to said central longitudinal axis of said support core means and has a length approximately equal to the length of said elongated cylindrical inner peripheral surface of said support sleeve means and has a diameter approximately equal to the diameter of said elongated cylindrical inner peripheral surface of said support sleeve means, and said support core means having an axially outermost end portion with a radially inwardly extending exterior surface having a profile corresponding to the interior surface profile of said tip portion of said support sleeve means for abutting supporting engagement therewith, and said support core member having an axially innermost end portion which is axially inwardly spaced from said axially innermost end portion of said support sleeve means;

at least two axially spaced precision cylindrical bearing support means associated with said support core means for receiving and supporting at least two axially spaced bearing unit means on and in coaxially and concentrically associated relationship with the support shaft; and interface bonding means for providing a continuous bonded cylindrical surface interface between said cylindrical inner peripheral surface of said workpiece support sleeve means and said cylindrical outer peripheral surface of said support core means and for fixedly permanently connecting said workpiece support sleeve means to said support core means to provide a unitary mandrel assembly.

2. The invention as defined in claim 1 and wherein:

said axially spaced bearing support means comprising counterbore portions at opposite ends of said support core member; and said bearing means comprising ball bearing units.

3. The invention as defined in claim 2 and further comprising:

a groove adjacent one of said counterbore portions;

a snap ring means mounted in said groove for holding said ball bearing unit in said counterbore portion; and said other one of said counterbore portions holding said ball bearing unit by a press fit therewithin.

4. The invention as defined in claim 1 or 2 or 3 and wherein said support core means further comprising:

an elongated sleeve member made of aluminum material and having a pair of axially spaced cylindrical bearing surfaces with associated radially inwardly extending bearing shoulders for receiving and supporting a pair of axially spaced bearing unit means mounted on the support shaft.

5. The invention as defined in claim 1 and wherein said tip portion of said workpiece support sleeve means further comprises:

a beveled outer surface for receiving and guiding the workpiece onto said support sleeve means.

6. The invention as defined in claim 5 and wherein said workpiece support sleeve means further comprising:

a beveled inner surface at said tip portion to facilitate insertion of said bearing unit means; and groove means adjacent said beveled inner surface for receiving a snap ring means for holding said bearing unit means in said counterbore.

* * * * *